US010472123B2

(12) United States Patent
Little

(10) Patent No.: US 10,472,123 B2
(45) Date of Patent: Nov. 12, 2019

(54) RETAIL-READY CONTAINER

(71) Applicant: Troy M. Little, Thomasville, PA (US)

(72) Inventor: Troy M. Little, Thomasville, PA (US)

(73) Assignee: GYRE INNOVATIONS, LLC, York, PA (US)

( * ) Notice: Subject to any disclaimer, the term of this patent is extended or adjusted under 35 U.S.C. 154(b) by 319 days.

(21) Appl. No.: 15/432,333

(22) Filed: Feb. 14, 2017

(65) Prior Publication Data

US 2017/0240315 A1 Aug. 24, 2017

Related U.S. Application Data

(60) Provisional application No. 62/297,553, filed on Feb. 19, 2016.

(51) Int. Cl.

| | |
|---|---|
| ***B65D 5/54*** | (2006.01) |
| ***B65D 5/02*** | (2006.01) |
| ***B65D 5/42*** | (2006.01) |
| ***B65D 5/64*** | (2006.01) |
| ***B65D 5/68*** | (2006.01) |
| ***B65D 5/32*** | (2006.01) |
| ***B31B 50/60*** | (2017.01) |
| *B31B 50/26* | (2017.01) |
| *B31B 50/62* | (2017.01) |
| *B31B 50/81* | (2017.01) |
| *B31B 100/00* | (2017.01) |
| *B31B 120/00* | (2017.01) |

(52) U.S. Cl.

CPC ..... *B65D 5/5445* (2013.01); *B31B 50/60* (2017.08); *B65D 5/02* (2013.01); *B65D 5/328* (2013.01); *B65D 5/4266* (2013.01); *B65D 5/4279* (2013.01); *B65D 5/64* (2013.01); *B65D 5/68* (2013.01); *B31B 50/26* (2017.08); *B31B 50/62* (2017.08); *B31B 50/81* (2017.08); *B31B 2100/00* (2017.08); *B31B 2120/00* (2017.08)

(58) Field of Classification Search

CPC ..... B65D 5/5445; B65D 5/328; B65D 5/02; B65D 5/4266; B65D 5/4279; B65D 5/64; B65D 5/68

See application file for complete search history.

(56) References Cited

U.S. PATENT DOCUMENTS

| | | | | |
|---|---|---|---|---|
| 5,715,993 | A * | 2/1998 | Pareike | B65D 5/5445 229/122.34 |
| 5,842,576 | A | 12/1998 | Snow | |
| 7,717,324 | B2 | 5/2010 | Keefe | |
| 8,281,981 | B2 | 10/2012 | Foden | |
| 8,376,141 | B2 | 2/2013 | Couture | |
| 8,430,296 | B2 | 4/2013 | Mathieu et al. | |
| 8,430,297 | B2 | 4/2013 | Gatrost | |
| 8,752,708 | B2 | 6/2014 | Keefe | |
| 8,939,290 | B2 | 1/2015 | DeCello et al. | |
| 2012/0193406 | A1 | 8/2012 | Putt | |

* cited by examiner

*Primary Examiner* — Steven A. Reynolds
*Assistant Examiner* — Javier A Pagan
(74) *Attorney, Agent, or Firm* — Barnes & Thornburg LLP

(57) ABSTRACT

A blank is configured to be erected into a container including an inner tray and an outer carton frangibly connected to the inner tray. The inner tray includes an inner side wall and a bottom. The outer carton includes a top, an outer side wall, and a utility panel frangibly connected to the inner side wall.

26 Claims, 7 Drawing Sheets

RETAIL-READY CONTAINER

CROSS-REFERENCE TO RELATED APPLICATION

This application claims benefit under 35 U.S.C. § 119 of U.S. Provisional Patent Application No. 62/297,553, filed Feb. 19, 2016, and incorporates by reference the disclosure thereof in its entirety.

BACKGROUND AND SUMMARY OF THE DISCLOSURE

The disclosure is directed to a retail-ready container formable from a single blank. The container includes an inner tray and an outer carton covering the inner tray. The outer carton is connected to the inner tray via a frangible connection.

DETAILED DESCRIPTION OF THE DRAWINGS

Figure 1:
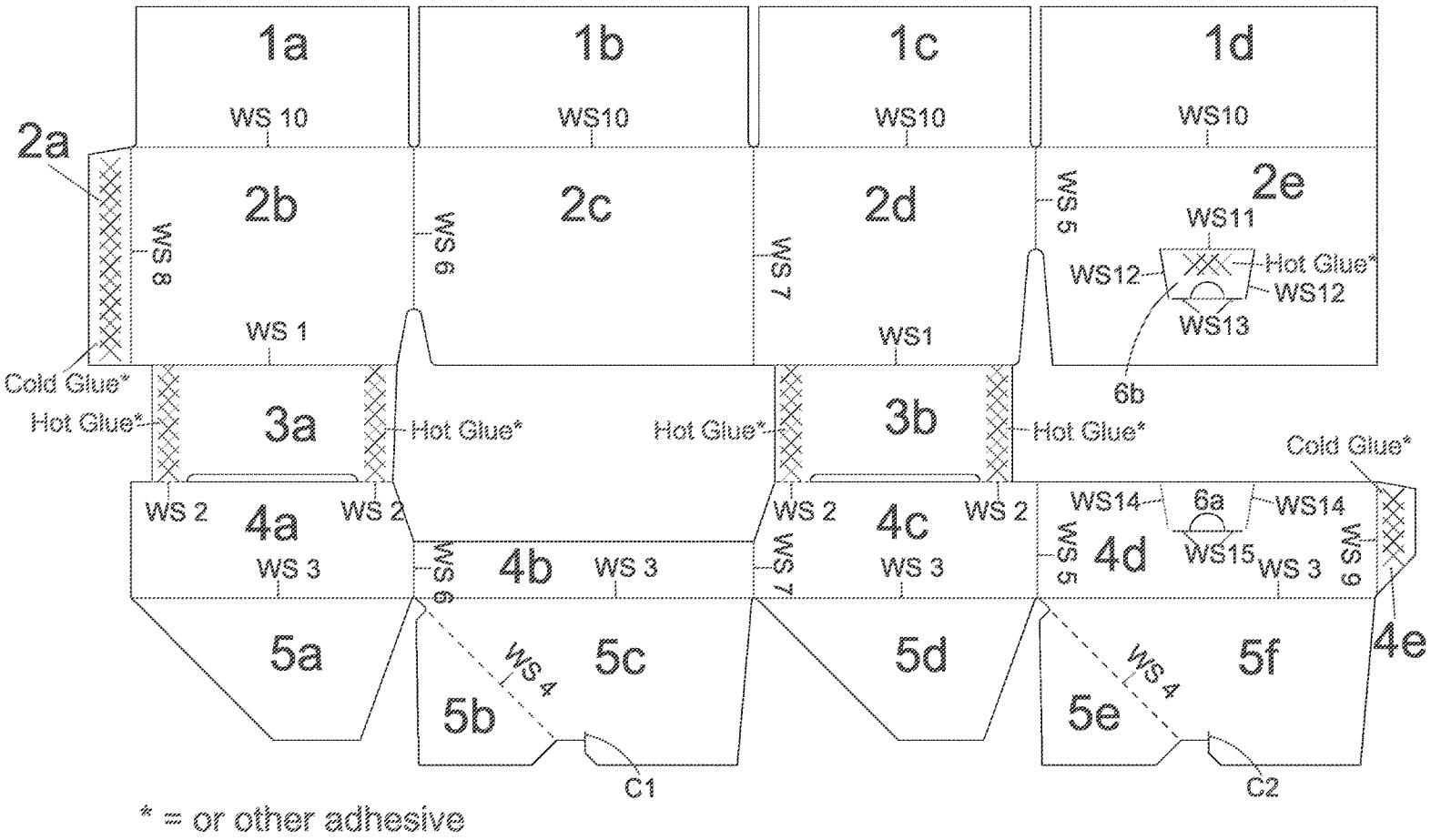
FIG. 1 is a top plan view of a blank for a retail-ready container according to the present disclosure.

FIG. 1 shows a blank for a retail-ready container having an inner tray and a removable outer carton covering the inner tray according to the present disclosure.

The blank includes top panels 1A, 1B, 1C, 1D and outer side panels 2A, 2B, 2C, 2D, 2E that define the outer carton. The blank also includes inner side panels 4A, 4B, 4C, 4D, 4E and bottom panels 5A, 5B, 5C, 5D, 5E, 5F that define the inner tray. The blank further includes utility panels 3A, 3B that join the outer carton to the inner tray.

Outer side panels 2B and 2D are joined, respectively, to utility panels 3A and 3B, along fold lines WS1. Utility panels 3A and 3B are joined, respectively, to inner side panels 4A and 4C along fold lines WS2. Inner side panels 4A, 4B, 4C, and 4D are joined, respectively, to bottom panels 5A, 5C, 5D and 5F respectively along fold lines WS3. Bottom panel 5B is joined to bottom panel 5C along fold line WS4A. Bottom panel 5E is joined to bottom panel 5F along fold line WS4B. Outer side panel 2D is joined to outer container side panel 2E along fold line WS5. Inner side panel 4C is joined to inner side panel 4D along fold line WS5. Outer side panel 2B is joined to outer side panel 2C along fold line WS6. Inner side panel 4A is joined to inner side panel 4B along fold line WS6. Outer side panel 2C and inner side panel 4B are joined, respectively, to outer side panel 2D and inner side panel 4C along fold line WS7. Outer side panel 2A is joined to outer side panel 2B along fold line WS8. Inner side panel 4E is joined to inner side panel 4D along fold line WS9. Top panels 1A, 1B, 1C, and 1D are joined, respectively, to outer side panels 2B, 2C, 2D and 2E along fold line WS10.

Outer side panel 2E defines a hinged tab 6B. Hinged tab 6B is joined to the remainder of outer side panel 2E by fold line WS11 and by frangible connection lines WS12 and WS13.

Inner side panel 4D defines a removable tab 6A. Removable tab 6A is joined to the remainder of inner side panel 4D by frangible connection lines WS14 and WS15.

Each of fold lines WS1, WS2, WS3, WS4A, WS4B, WS 5, WS6, WS7, WS8, WS9, WS10, and WS11 may be scored or creased to facilitate the folding of the corresponding panels there about. Fold lines WS2 may be frangible, for example, perforated or otherwise formed to facilitate removal of the outer carton from the inner tray, as will be discussed further below.

Frangible connection lines WS12 and WS13 may be perforated or otherwise formed to facilitate separation of hinged tab 6B from outer side panel 2E along frangible connection lines WS12 and WS13, as will be discussed further below. Alternatively, frangible connection lines WS12 and/or WS13 may represent a complete separation of adjacent portions of outer side panel 2E and hinged tab 6B from each other. Similarly, frangible connection lines WS14 and WS15 may be frangible, for example, perforated or otherwise formed to facilitate separation of removable tab 6A from outer side panel 4D along frangible connection lines WS14 and WS15, as will be discussed further below. In an embodiment, frangible connection line WS15 may be a cut line completely separating adjacent portions of inner side panel 4D and removable tab 6A from each other.

A first cut line C1 generally perpendicular to fold line WS3 extends inwardly from a free edge of bottom panel 5C toward fold line WS3. A second cut line C2 generally perpendicular to fold line WS3 extends inwardly from a free edge of bottom panel 5F.C toward fold line WS3.

Figure 2A:
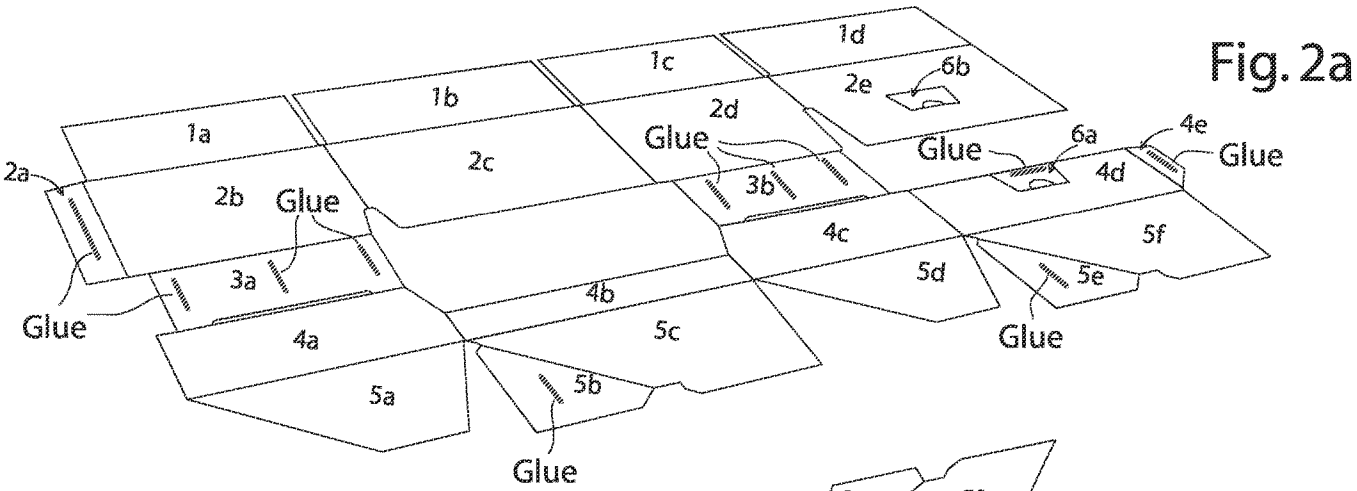
FIG. 2A is a perspective view of the blank of FIG. 1.

As best illustrated in FIGS. 2A-2G, the blank 10 may be converted to a preassembly as follows. First, as best shown in FIG. 2A, a hot melt or other glue or other adhesive (individually or collectively, "adhesive") may be applied to utility panels 3A, 3B and hinged tab 6B where shown. Alternatively, the adhesive could be applied to corresponding portions of outer side panels 2B, 2D and removable tab 6A, respectively (the corresponding portion of removable tab 6A is on the side of the blank 10 opposite the side of the blank 10 that is shown in FIG. 1).

Figure 2B:
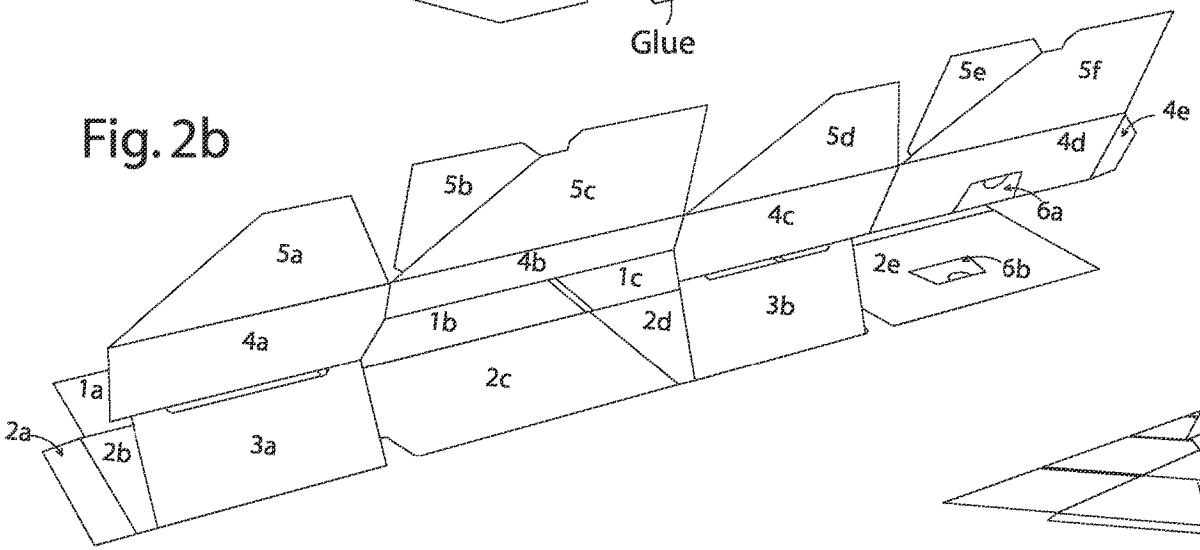
FIG. 2B to 2G show various stages of conversion of the blank of FIG. 2A to a preassembly.
Figure 2C:
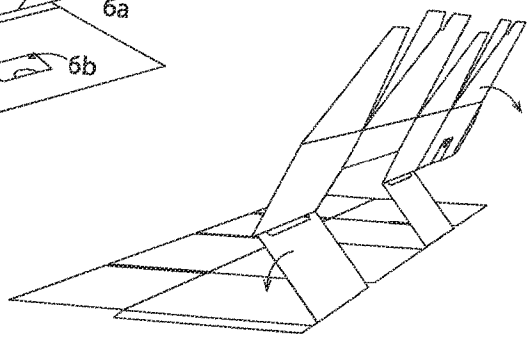

As best shown in FIGS. 2B, and 2C, utility panels 3A and 3B may be folded along fold line WS1 onto outer side panels 2B, 2D, respectively, thereby adhering utility panels 3A and 3B to outer side panels 2B and 2D.

Figure 2D:
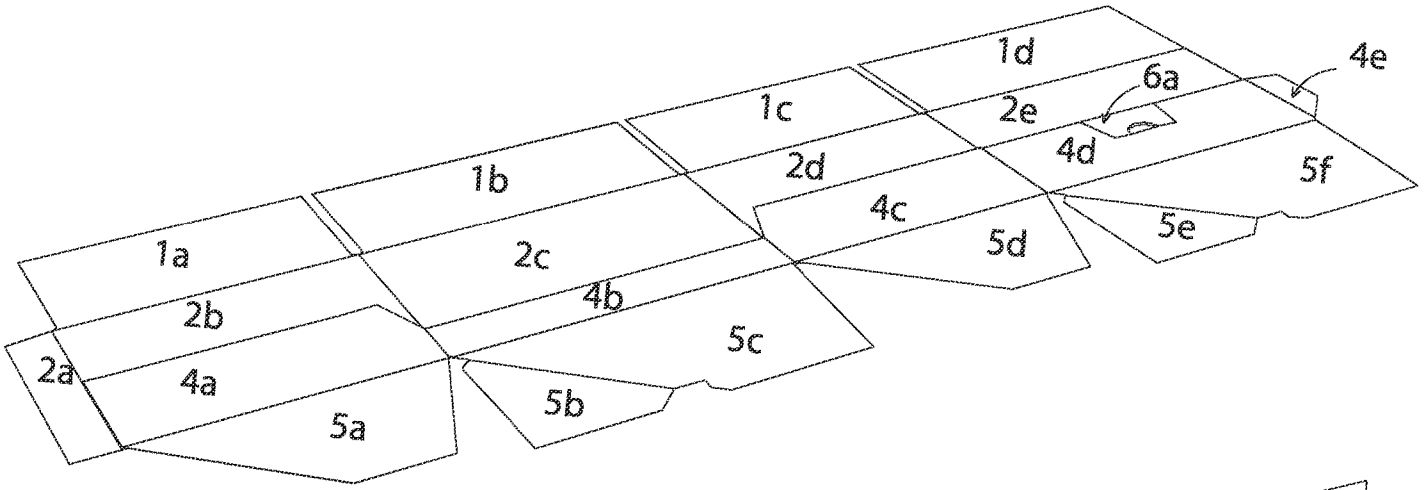

As best shown in FIGS. 2C, and 2D, inner side panels 4A and 4C may be folded against the opposite side of utility panels 3A and 3B along fold line WS2, thereby causing removable tab 6A to become adhered to hinged tab 6B.

Figure 2E:
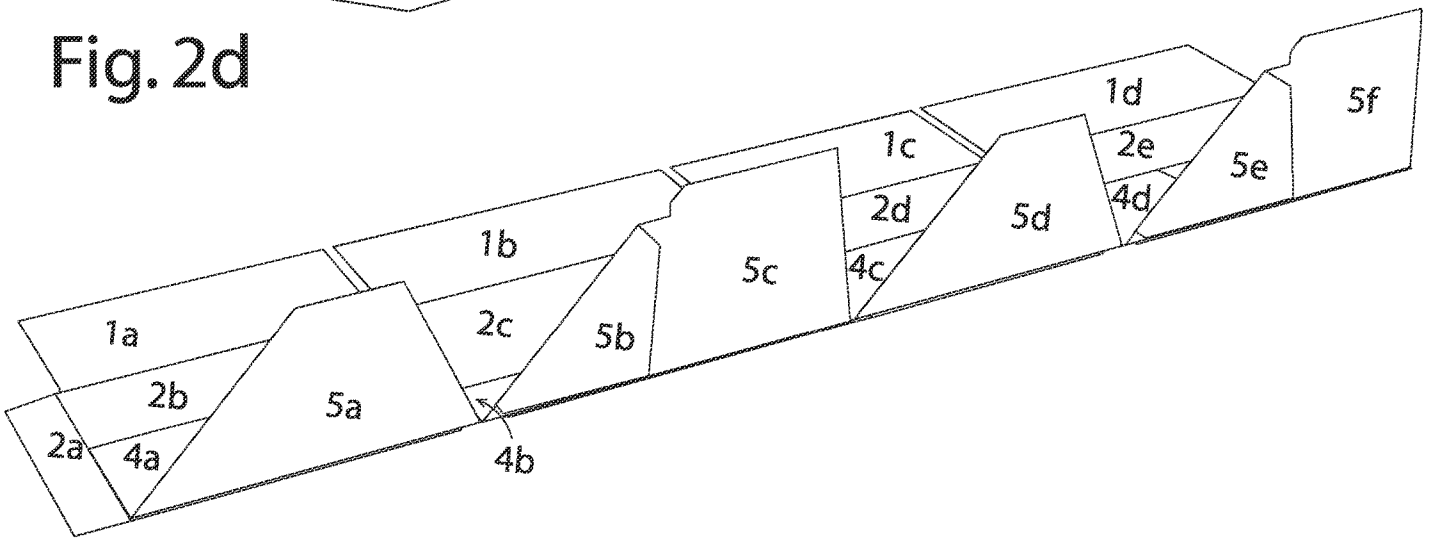
Figure 2F:
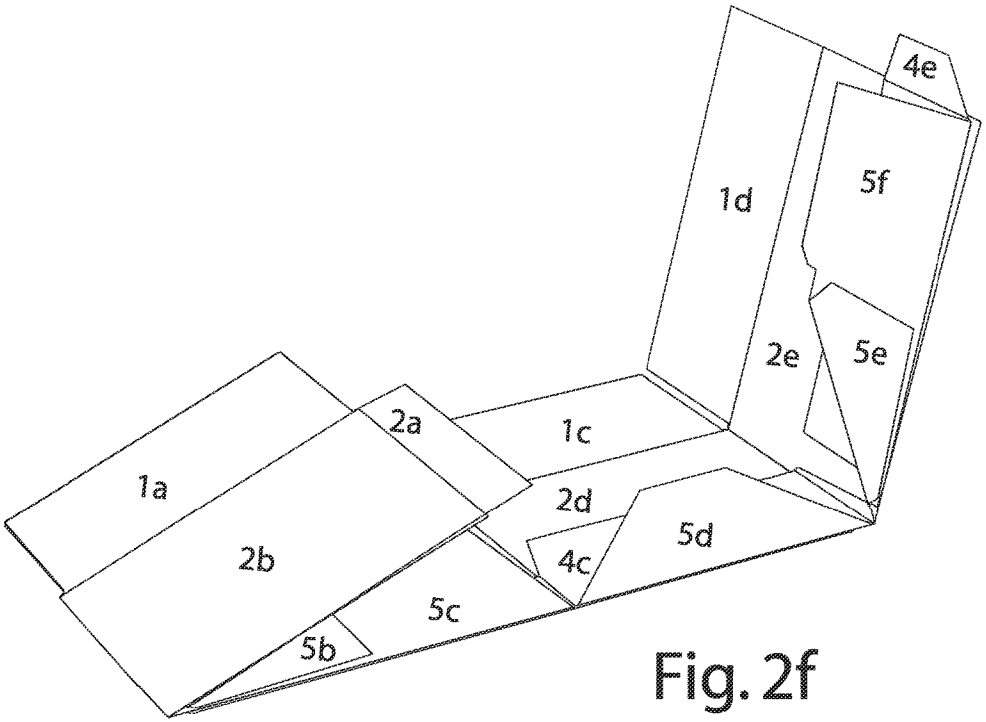

As best shown in FIG. 2F, bottom panels 5A, 5C, 5D and 5F may be folded upon side panels 4A, 4B, 4C and 4D along fold line WS3.

As best shown in FIG. 2E, bottom panel 5E may be folded upon bottom panel 5F along fold line WS4B. Adhesive may be applied to the surface of bottom panel 5E visible in FIGS. 2E and 2F or a corresponding portion of bottom panel 5D. Outer side panel 2E and inner side panel 4D may be folded along fold lines WS5 onto outer side panel 2D and inner side panel 4C, respectively, thereby adhering the surface of bottom panel 5E visible in FIGS. 2E and 2F onto the surface of bottom panel 5D visible in FIGS. 2E and 2F.

Figure 2G:
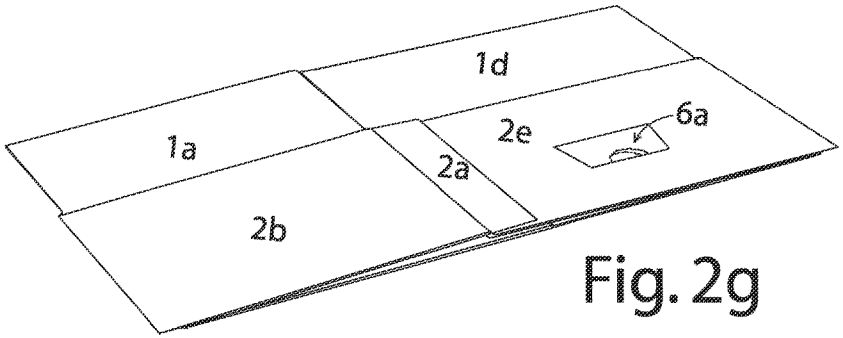

As best shown in FIG. 2E, bottom panel 5B may be folded upon bottom panel 5C along fold line WS4B. Adhesive may be applied to the surface of bottom panel 5B visible in FIGS. 2E and 2F or a corresponding portion of bottom panel 5A. Adhesive also may be applied to the surface of outer side panel 2A visible in FIG. 2E and the surface of inner side panel 4E visible in FIGS. 2D and 2F. Outer side panel 2B and inner side panel 4A may be folded along fold lines WS6 onto outer side panel 2C and inner side panel 4B, respectively, thereby adhering the surface of bottom panel 5B visible in FIGS. 2 2E and 2F to the surface of bottom panel 5A visible in FIG. 2E, adhering the surface of inner side panel 4E visible in FIG. 2F to the surface of inner side panel 4A visible in FIG. 2E, and adhering the surface of outer side panel 2A visible in FIG. 2E to the surface of outer side panel 2E visible in FIG. 2G. The completed preassembly is shown in FIG. 2G.

Figure 3A:
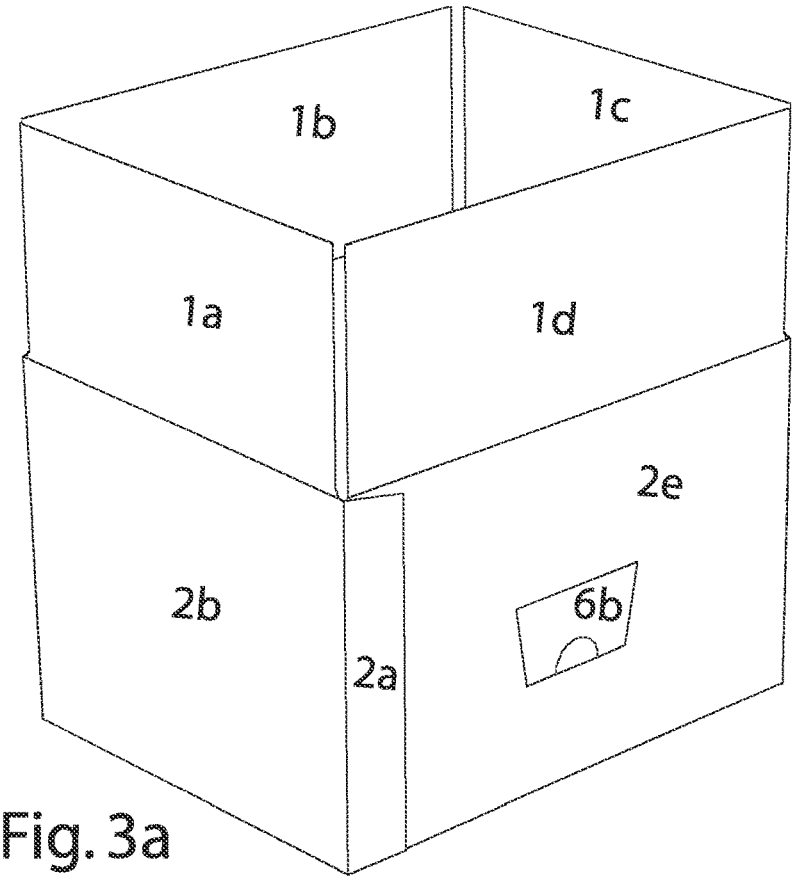
FIG. 3A shows an open container erected from the preassembly of FIG. 2G.

The preassembly may be converted to a retail ready container by folding inner and outer side panels 2C and 4B toward inner and outer side panels 2D and 4C, respectively, along fold line WS7. This may be accomplished by applying a force to fold line WS7 directed to fold lines WS8 and WS9, and an opposing force to fold lines WS8 and WS9. Consequently, inner and outer side panel 2B and 4A partially unfold from inner and outer side panels 2C and 4B, respectively, along fold line WS6, and inner and outer side panels 2D and 4C partially unfold from inner and outer side panels 2E and 4D, respectively, along fold line WS5. Also, bottom panels 5B and 5E partially unfold, respectively, from bottom panels 5C and 5F along fold lines WS4A and WS4B. In the course of doing so, bottom panels 5C and 5F engage and interlock, thereby yielding a retail ready container as shown in FIG. 3A. Cut lines C1 and C2 may allow for flexing of portions of bottom panels 5C and 5F with respect to each other as they engage and interlock.

So erected, the retail ready container may be filled with goods to be contained therein. Top panels 1A, 1B, 1C, and 1D may be folded along fold line WS10 and secured as desired, thereby yielding the container shown in FIG. 3B.

Figure 3B:
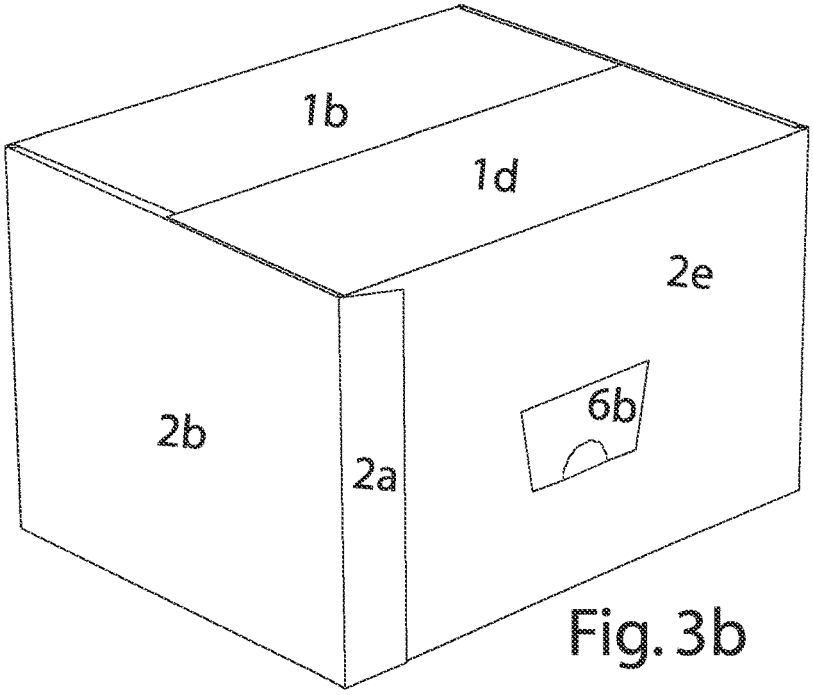
FIG. 3B shows the container of FIG. 3A with the top portion closed.
Figure 3C:
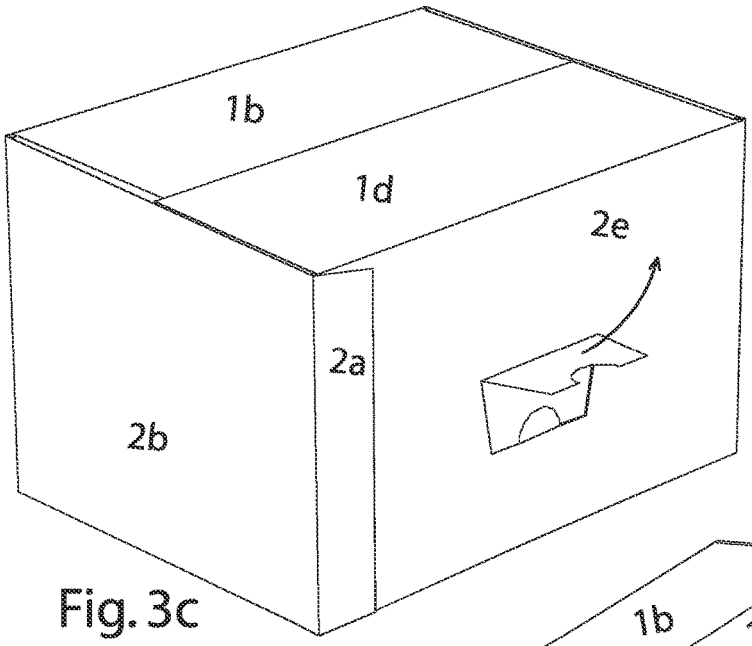
FIG. 3C and FIG. 3D show the removal of an outer portion of the container of FIG. 3A from an inner portion thereof.

The closed container as shown in FIG. 3B may be opened by pulling on hinged tab 6B, which is glued to removable tab 6A, thereby separating removable tab 6A from inner panel 4D along frangible connection lines WS14 and WS15, separating hinged tab 6B from outer side panel 2E and pivoting hinged tab about fold line WS11. This operation is best shown in FIGS. 3C and 5C.

Figure 3D:
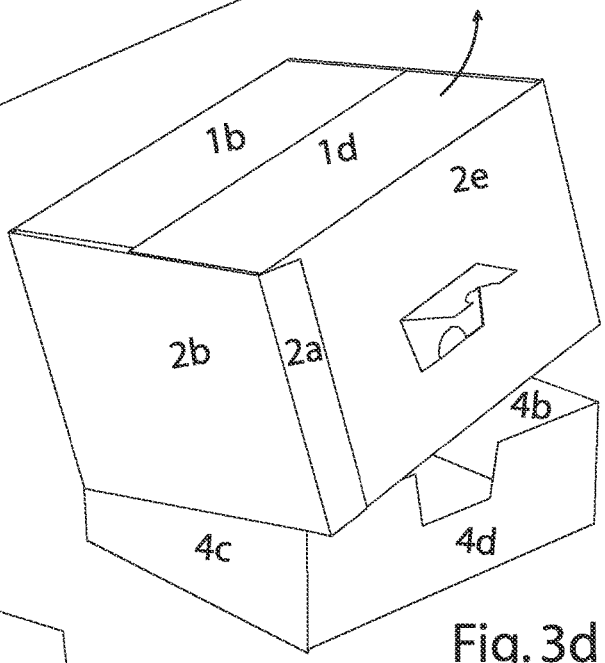
Figure 3E:
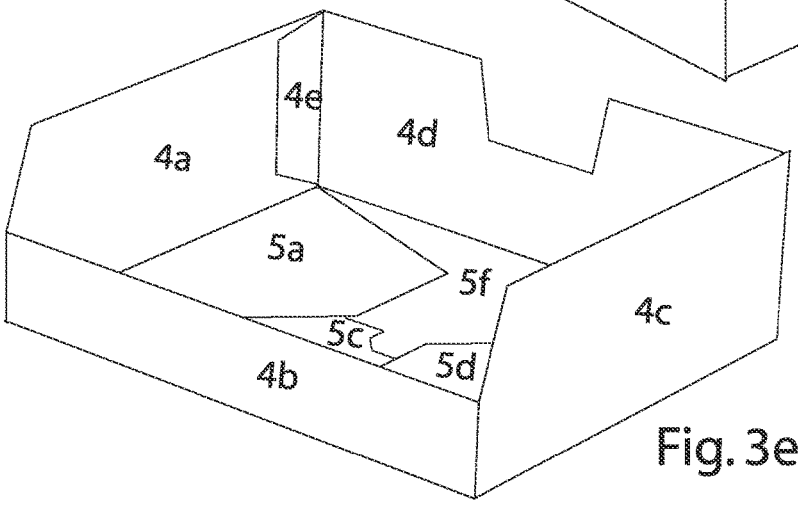
FIG. 3E shows the inner portion of the container of FIG. 3A with the outer portion removed.

As shown in FIG. 3D, the outer carton comprising top panels 1A, 1B, 1C, 1D and outer side panels 2A, 2B, 2C, 2D, and incorporating utility panels 3A, 3B may be removed from the inner tray comprising inner side panels 4A, 4B, 4C, 4D, 4E and bottom panels 5A, 5B, 5C, 5D, 5E, 5F by tearing utility panels 3A and 3B from inner tray side panels 4A and 4C along frangible connection defined by fold line WS2 to yield a retail ready tray as shown in FIG. 3E.

Inner side panel 4B is shown in FIG. 1 as extending a first distance from fold line WS3 toward fold line WS1, and inner side panels 4A, 4C, and 4D are shown in FIG. 1 as extending a second distance from fold line WS3 toward fold line WS1, the second distance being greater than the first distance. This feature results in the inner tray having a front side wall (defined by inner side panel 4B) that is shorter than its left, right, and rear side walls (defined by inner side panels 4A, 4C, and 4D, respectively), the left, right, and rear side walls each having the same height, as shown in FIG. 3E. The relatively short front side wall may improve access to items disposed on the inner tray, while the relatively long left, right, and rear side walls may preclude such items from inadvertently falling out of the inner tray.

Also, each of the outer side panels 2B, 2C, 2D, 2E is shown in FIG. 1 as extending a third distance from fold line WS1 toward fold line WS10, the third distance being greater than both the first distance and the second distance referred to above. This feature results in the outer carton having side walls substantially higher than the side walls of the inner tray. The differential in sidewall height allows for items disposed in the inner to tray to extend above side walls of the inner tray, yet be fully contained with the outer carton before the outer carton is removed from the inner tray.

In an embodiment, the relative dimensions of inner side panels 4A, 4B, 4C, 4D outer side panels 2B, 2C, 2D, 2E may be selected as desired to yield an inner tray and outer carton having side walls of any desired height.

Figure 4:
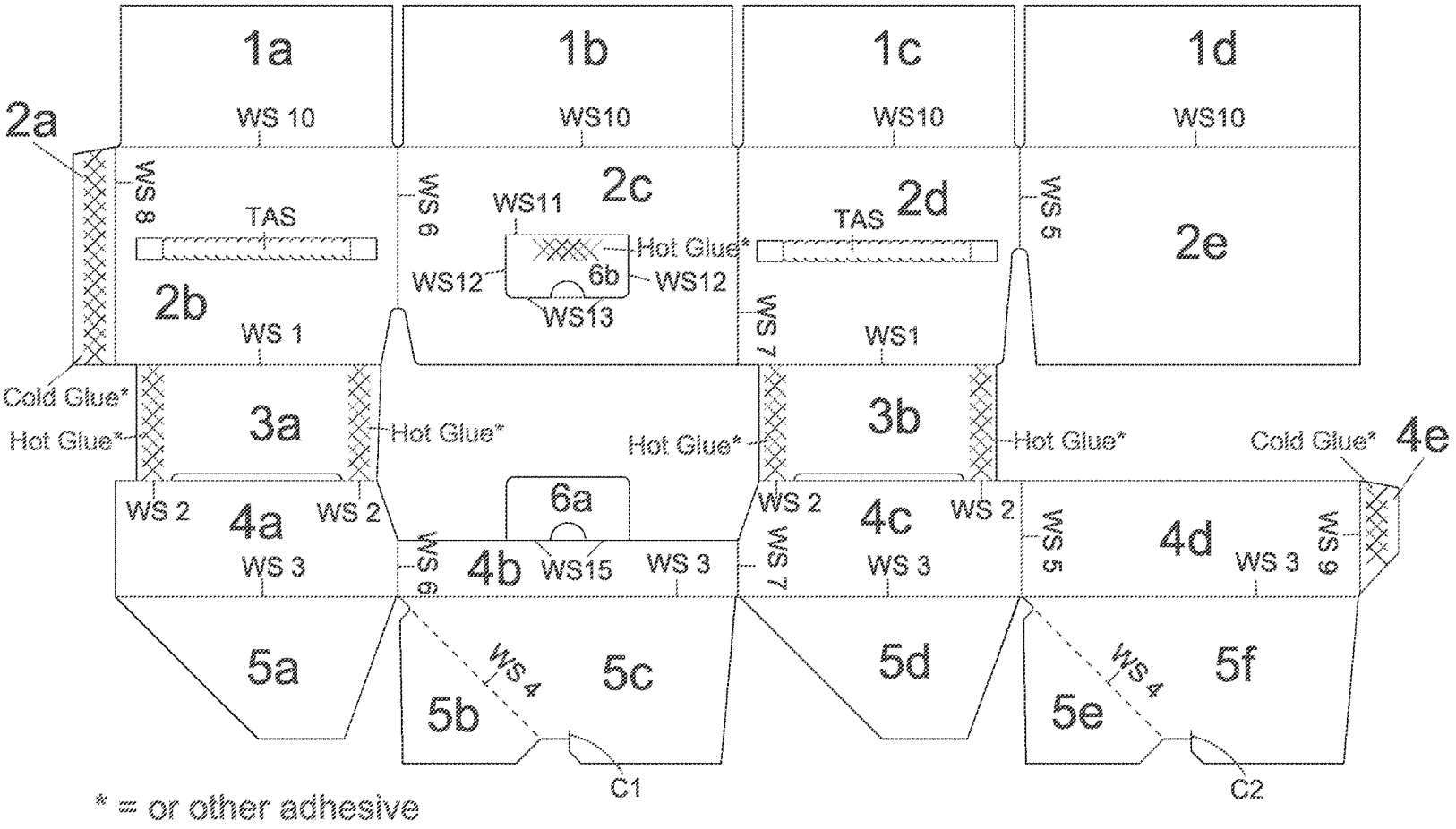
FIG. 4 is a top plan view of an alternative blank for an alternative retail-ready container according to the present disclosure.

In an embodiment, hinged tab 6B and removable tab 6A could be moved from outer side panel 2E and inner side panel 4D, respectively, to another pair of corresponding outer and inner side panels. For example, as shown in FIG. 4, hinged tab 6B could be moved to outer side panel 2C and removable tab 6A could be moved to inner side panel 4B. In this embodiment, removable tab 6A extends from a free edge of inner side panel 4B facing outer side panel 2C, and is attached thereto by a frangible connection. In another embodiment, hinged tab 6B and removable tab 6A could be omitted.

In a further embodiment, as also shown in FIG. 4, either or both of outer side panels 2B and 2D could be provided with tear-away strips TAS frangibly connected thereto. The strips TAS could be located to generally coincide with the locations of fold lines WS2 when inner side panels 4A and 4C are folded against outer side panels 2B and 2D, respectively, as discussed above. With the retail-ready container erected as discussed above, the strips TAS could be removed to define an opening through the outer side walls 2B and 2D, the opening providing access to the frangible connections defined by the fold lines WS2. A user could apply finger pressure or a tool to the fold lines WS2, through the opening, to assist in breaking the foregoing frangible connections.

In an embodiment (not shown), bottom panel 5A could be dimensioned analogous to top panel 1A, bottom panels 5B, 5C could be collectively dimensioned analogous to top panel 1B, bottom panel 5D could be dimensioned analogous to top panel 1C, and bottom panels 5E, 5F could be collectively dimensioned analogous to top panel 1D. In such an embodiment, a preassembly could be made by folding utility panels 3A and 3B about fold line WS1 against outer side panels 2B and 2D, adhering utility panels 3A and 3B to outer side panels 2B and 2D, folding inner side panels 4A and 4C about fold line WS2 against the opposite side of utility panels 3A and 3B, adhering removable tab 6A to hinged tab 6B, adhering inner side panel 4E to inner side panel 4A, and adhering outer side panel 2A to outer side panel 2E as described above.

The foregoing preassembly could be converted to a retail ready container by folding inner and outer side panels 2C and 4B toward inner and outer side panels 2D and 4C, respectively, along fold line WS7. This may be accomplished by applying a force to fold line WS 7 directed to fold lines WS8 and WS9, and an opposing force to fold lines WS8 and WS9. Consequently, inner and outer side panel 2B and 4A partially unfold from inner and outer side panels 2C and 4B, respectively, along fold line WS6, and inner and outer side panels 2D and 4C partially unfold from inner and outer side panels 2E and 4D, respectively, along fold line WS5. Bottom panels 5A-5F could be folded along fold line WS3 to engage with each other in a conventional manner and could be secured using tape, staples, or other conventional means. For example, bottom panels 5A and 5C could be folded toward each other, and bottom panels 5B/5C and 5D/5E could be folded toward each other in overlying relationship and/or engagement with bottom panels 5A and 5C and secured as discussed above.

References herein to orientation, direction, dimension, and the like, for example, top, bottom, side, front, rear, shorter, longer, and the like, refer to relative orientation, direction, and dimension. Such references should not be construed to refer to absolute orientation, direction, or dimension unless context dictates otherwise.

The foregoing description and drawings are illustrative and should not be construed as limiting the appended claims.

The invention claimed is:

1. A blank for a retail-ready container, the blank comprising:

a first plurality of panels, a second plurality of panels, and a third plurality of panels, the first plurality of panels and the second plurality of panels connected together along a first fold line, and the second plurality of panels and the third plurality of panels connected together along a second fold line, wherein the second fold line is frangible;

each of the first plurality of panels, the second plurality of panels, and the third plurality of panels having a first surface and a second surface opposite the first surface, the first surface of the second plurality of panels contiguous with the first surface of the first plurality of panels and the first surface of the third plurality of panels, and the second surface of the second plurality of panels contiguous with the second surface of the first plurality of panels and the second surface of the third plurality of panels;

the first surface of the second plurality of panels foldable against the first surface of the first plurality of panels about the first fold line, and the second surface of the third plurality of panels foldable against the second surface of the second plurality of panels about the second fold line to thereby position the second surface of the third plurality of panels adjacent the first surface of the first plurality of panels.

2. The blank of claim 1 further comprising:

a fourth plurality of panels and a fifth plurality of panels, the first plurality of panels and the fourth plurality of panels connected together along a third fold line, and the third plurality of panels and the fifth plurality of panels connected together along a fourth fold line.

3. The blank of claim 2 wherein each of the first, third, fourth, and fifth plurality of panels includes first, second, third, and fourth panels, the first panel of each of the first and third pluralities of panels connected to a corresponding second panel along a fifth fold line, the second panels of each of the first and third pluralities of panels connected to a corresponding third panel about a sixth fold line, and the third panels of each of the first and third pluralities of panels connected to a corresponding fourth panel about a seventh fold line, and wherein the second plurality of panels includes a first panel and a second panel.

4. The blank of claim 3 wherein the first panel of the second plurality of panels is connected to the first panel of the first plurality of panels along the first fold line and further is connected to the first panel of the third plurality of panels along the second fold line, wherein the second panel of the second plurality of panels is connected to the third panel of the first plurality of panels along the first fold line and further is connected to the third panel of the third plurality of panels along the second fold line, and wherein the second panel of the third plurality of panels and the fourth panel of the third plurality of panels are not directly connected to any panel of the second plurality of panels.

5. The blank of claim 3 wherein the first plurality of panels further comprises a fifth panel foldable with respect to the corresponding first panel or fourth panel about an eighth fold line and wherein the third plurality of panels further comprises a fifth panel foldable with respect to the corresponding first panel or fourth panel about a ninth fold line.

6. The blank of claim 5 wherein the second panel of the fifth plurality of panels comprises a first subpanel and a second subpanel, the second subpanel connected to the first subpanel about a first intermediate fold line, and wherein the fourth panel of the fifth plurality of panels comprises a first subpanel and a second subpanel, the second subpanel connected to the first subpanel about a second intermediate fold line.

7. The blank of claim 6 wherein each of the first subpanel of the second panel of the fifth plurality of panels and the first subpanel of the fourth panel of the fifth plurality of panels comprises a cut line extending perpendicularly from an edge of the respective subpanel opposite the fourth fold line.

8. The blank of claim 7 wherein each of the first subpanel of the second panel of the fifth plurality of panels and the first subpanel of the fourth panel of the fifth plurality of panels defines a notch adjacent the corresponding cut line.

9. The blank of claim 3 wherein the second panel of the third plurality of panels extends a first distance from the fourth fold line toward the first fold line and the fourth panel of the third plurality of panels extends a second distance from the fourth fold line toward the first fold line, the second distance being greater than the first distance.

10. The blank of claim 3 wherein at least one of the first plurality of panels extends a greater distance from the first fold line toward the third fold line than the greatest distance any panel of the third plurality of panels extends from the fourth fold line toward the first fold line.

11. A preassembly formed from the blank of claim 8 by:

folding the second plurality of panels against the first plurality of panels about the first fold line;

adhering the first and second panels of the second plurality of panels to the first and third panels of the first plurality of panels;

folding the third plurality of panels against the first plurality of panels about the second fold line;

folding the fifth plurality of panels against the third plurality of panels;

folding the second subpanel of the second panel of the fifth plurality of panels against the first subpanel of the second panel of the fifth plurality of panels;

folding the second subpanel of the fourth panel of the fifth plurality of panels against the first subpanel of the fourth panel of the fifth plurality of panels;

folding the first panel of the fifth plurality of panels against the second panel of the fifth plurality of panels along the fifth fold line;

folding the fourth panel of the fifth plurality of panels against the third panel of the fifth plurality of panels along the seventh fold line;

adhering the second subpanel of the second panel of the fifth plurality of panels to the first panel of the fifth plurality of panels;

adhering the second subpanel of the fourth panel of the fifth plurality of panels to the third panel of the fifth plurality of panels;

adhering the fifth panel of the first plurality of panels to the first or fourth panel of the first plurality of panels; and adhering the fifth panel of the third plurality of panels to the first or fourth panel of the third plurality of panels.

12. A retail-ready container constructed from the preassembly of claim 11 by:

unfolding the first panel of the fifth plurality of panels from the second panel of the fifth plurality of panels along the fifth fold line;

unfolding the fourth panel of the fifth plurality of panels from the third panel of the fifth plurality of panels along the seventh fold line;

unfolding the first through fourth panels of the fifth plurality of panels from the first through fourth panels of the fourth plurality of panels;

interlocking the second panel of the fifth plurality of panels with the fourth panel of the fifth plurality of panels about the respective cut lines thereof.

13. A method of using the retail-ready container of claim 12 comprising:

disconnecting the third plurality of panels from the second plurality of panels at the second fold line; and separating an outer carton comprising the first, second, and fourth plurality of panels from a tray comprising the third and fifth plurality of panels.

14. The blank of claim 8, the first plurality of panels defining a hinged tab and the third plurality of panels defining a removable tab.

15. A preassembly formed from the blank of claim 14 by:

folding the second plurality of panels against the first plurality of panels about the first fold line;

adhering the first and second panels of the second plurality of panels to the first and third panels of the first plurality of panels;

folding the third plurality of panels against the first plurality of panels about the second fold line;

adhering the removable tab to the hinged tab;

folding the fifth plurality of panels against the third plurality of panels;

folding the second subpanel of the second panel of the fifth plurality of panels against the first subpanel of the second panel of the fifth plurality of panels;

folding the second subpanel of the fourth panel of the fifth plurality of panels against the first subpanel of the fourth panel of the fifth plurality of panels;

folding the first panel of the fifth plurality of panels against the second panel of the fifth plurality of panels along the fifth fold line;

folding the fourth panel of the fifth plurality of panels against the third panel of the fifth plurality of panels along the seventh fold line;

adhering the second subpanel of the second panel of the fifth plurality of panels to the first panel of the fifth plurality of panels;

adhering the second subpanel of the fourth panel of the fifth plurality of panels to the third panel of the fifth plurality of panels;

adhering the fifth panel of the first plurality of panels to the first or fourth panel of the first plurality of panels; and adhering the fifth panel of the third plurality of panels to the first or fourth panel of the third plurality of panels.

16. A retail-ready container constructed from the preassembly of claim 15 by:

unfolding the first panel of the fifth plurality of panels from the second panel of the fifth plurality of panels along the fifth fold line;

unfolding the fourth panel of the fifth plurality of panels from the third panel of the fifth plurality of panels along the seventh fold line;

unfolding the first through fourth panels of the fifth plurality of panels from the first through fourth panels of the fourth plurality of panels;

interlocking the second panel of the fifth plurality of panels with the fourth panel of the fifth plurality of panels about the respective cut lines thereof.

17. A method of using the retail-ready container of claim 16 comprising:

disconnecting the removable tab from the third plurality of panels;

disconnecting the third plurality of panels from the second plurality of panels at the second fold line; and separating an outer carton comprising the first, second, and fourth plurality of panels from a tray comprising the third and fifth plurality of panels.

18. A preassembly formed from the blank of claim 5 by:

folding the second plurality of panels against the first plurality of panels about the first fold line;

adhering the first and second panels of the second plurality of panels to the first and third panels of the first plurality of panels; and folding the third plurality of panels against the first plurality of panels about the second fold line.

19. The blank of claim 5, the first plurality of panels defining a hinged tab and the third plurality of panels defining a removable tab.

20. A preassembly formed from the blank of claim 19 by:

folding the second plurality of panels against the first plurality of panels about the first fold line;

adhering the first and second panels of the second plurality of panels to the first and third panels of the first plurality of panels; and folding the third plurality of panels against the first plurality of panels about the second fold line; and adhering the hinged tab to the removable tab.

21. A retail-ready container comprising:

an inner tray comprising a plurality of bottom panels and a plurality of inner side panels connected to corresponding ones of the plurality of bottom panels;

an outer carton comprising a plurality of top panels, a plurality of outer side panels connected to corresponding ones of the plurality of top panels, and a plurality of utility panels directly connected to corresponding ones of the plurality of outer side panels;

wherein the utility panels are frangibly connected to corresponding ones of the plurality of the inner side panels along a frangible connection line.

22. The retail-ready container of claim 21, the plurality of outer side panels comprising a hinged tab and the plurality of inner side panels comprising a removable tab in registration with the hinged tab.

23. The retail-ready container of claim 21, at least one of the outer side panels comprising a tear away strip in registration with the frangible connection line.

24. A retail-ready container comprising:

an inner tray comprising a plurality of bottom panels and a plurality of inner side panels connected to corresponding ones of the plurality of bottom panels;

an outer carton comprising a plurality of top panels, a plurality of outer side panels connected to corresponding ones of the plurality of top panels, and a plurality of utility panels connected to corresponding ones of the plurality of outer side panels;

wherein a first surface of each of the plurality of utility panels faces a corresponding surface of a corresponding one of the plurality of outer side panels and a second surface of each of the plurality of utility panels opposite the first surface faces a corresponding surface of a corresponding one of the plurality of inner side panels; and wherein the utility panels are frangibly connected to corresponding ones of the plurality of the inner side panels along a frangible connection line.

25. The retail-ready container of claim 24, the plurality of outer side panels comprising a hinged tab and the plurality of inner side panels comprising a removable tab in registration with the hinged tab.

26. The retail-ready container of claim 24, at least one of the outer side panels comprising a tear away strip in registration with the frangible connection line.

* * * * *